United States Patent [19]

Kopatz et al.

[11] Patent Number: 4,885,028

[45] Date of Patent: Dec. 5, 1989

[54] PROCESS FOR PRODUCING PREALLOYED TUNGSTEN ALLOY POWDERS

[75] Inventors: Nelson E. Kopatz, Sayre, Pa.; Walter A. Johnson, Houghton, Mich.; Jack E. Vanderpool, Laceyville; Howard H. Shaw, Monroeton, both of Pa.

[73] Assignee: GTE Products Corporation, Stamford, Conn.

[21] Appl. No.: 253,173

[22] Filed: Oct. 3, 1988

[51] Int. Cl.[4] ..... B22F 1/00

[52] U.S. Cl. ..... 75/0.5 BB; 75/0.5 C

[58] Field of Search ..... 75/0.5 BB, 0.5 C

[56] References Cited

U.S. PATENT DOCUMENTS

| | | | |
|---|---|---|---|
| 4,390,368 | 6/1983 | Houck | 75/0.5 BB |
| 4,731,111 | 3/1988 | Kopatz et al. | 75/0.5 AC |
| 4,743,297 | 5/1988 | Kopatz et al. | 75/0.5 BB |
| 4,778,515 | 10/1988 | Kemp, Jr. et al. | 75/0.5 BB |
| 4,793,969 | 12/1988 | Johnson et al. | 75/0.5 BB |

*Primary Examiner*—Upendra Roy

*Attorney, Agent, or Firm*—Donald R. Castle

[57] ABSTRACT

A process for forming particulate tungsten heavy alloys from agglomerated material containing the individual metals by using a high temperature zone is improved by retaining the material in the high temperature zone for a time sufficient to at least partially melt the metals that are alloying with tungsten while maintaining the temperature of those metals below the boiling point of the lowest boiling metal in the alloying component.

5 Claims, No Drawings

PROCESS FOR PRODUCING PREALLOYED TUNGSTEN ALLOY POWDERS

FIELD OF THE INVENTION

This invention relates to the preparation of composite tungsten heavy alloy metal powders containing a discontinuous tungsten phase. More particularly it relates to the production of such powders via agglomeration followed by plasma processing.

BACKGROUND OF THE INVENTION

Tungsten heavy alloys are that class of two phase multicomponent tungsten alloys containing tungsten and at least one other metal component such s, nickel, iron or copper. These alloys are defined in the *Metals Handbook,* Ninth Edition, Vol. 7. ASM, Metal Park, Ohio 44073. One phase in such alloys is essentially tungsten and the other phase is a solid-solution of tungsten and the other metal component.

Tungsten heavy alloy structures heretofore have been produced by liquid phase sintering of pressed powders. The liquid phase sintering process creates a very homogenous microstructure, however, the size of the tungsten grains grow from about 5 micrometers to over about 30 micrometers during the sintering process. If consolidation processes other than liquid phase sintering are used to achieve final densification, the microstructures have generally been insufficiently homogeneous to yield satisfactory mechanical properties unless certain additional working steps are taken to improve the mechanical properties of the consolidated billet.

It is believed that a relatively simple process which enables tungsten heavy alloy powders consisting essentially of tungsten and a second metal selected from the group consisting of iron, nickel, copper and mixtures thereof wherein the powder particles consisting essentially of a discontinuous tungsten phase relatively uniformly distributed in a matrix of tungsten and the second metal to be produced from sources of the individual metals without excessive tungsten grain growth would be an advancement in the art.

SUMMARY OF THE INVENTION

In accordance with one aspect of this invention there is provided a process for producing tungsten heavy alloy powders comprising:

(a) forming a relatively uniform blend of a relatively finely divided tungsten powder and a relatively finely divided second metal powder component wherein the second metal is selected from the group consisting of nickel, iron, copper and mixtures thereof wherein the tungsten constitutes from about 70% to about 98% by weight of the blend and the balance is the second metal component, (b) forming a solid particulate material containing the blend and a volatile binder, (c) forming agglomerates having a size of from about 10 to about 80 micrometers from the particulate material by heating to a temperature sufficient to remove the volatile binder, (e) entraining at least a portion of the agglomerates in a carrier gas to form a mixture, (f) feeding the resulting entrained agglomerates and gas mixture into a high temperature zone and retaining the agglomerates in the zone for a sufficient time to achieve a temperature in the agglomerates of between the melting point of the second metal component and the boiling point of the lowest boiling point metal in the second metal component to form partially molten droplets and (g) cooling such droplets to form a powdered tungsten heavy alloy wherein the powders consist of particles having essentially a spherical shape and the alloy has a continuous phase of an alloy of tungsten and the second metal component and a discontinuous tungsten phase containing individual tungsten grains of essentially the same size as the initial tungsten powder particles and wherein in the alloy, tungsten constitutes from about 70% to about 98% by weight of the alloy and the balance is the second metal component.

DETAILS OF THE PREFERRED EMBODIMENTS

For a better understanding of the present invention, together with other and further objects, advantages, and capabilities thereof, reference is made to the following disclosure and appended claims in connection with the foregoing description of some of the aspects of the invention.

U.S. Pat. Nos. 3,663,667; 3,909,241; 3,974,245; 4,025,334; 4,502,885 and 4,508,788; 4,592,781; 4,705,560; 4,723,993; 4,731,110; 4,731,111; and 4,756,746 all relate to the formation of free flowing powders via a high temperature plasma reactor to cause at least partial melting of the particles. Resulting powders are spherical and free flowing.

While the before-mentioned processes produce the products mentioned therein, it has been found that better overall yields can be obtained when certain tungsten alloys such as tungsten heavy alloys are desired by performing the process of this invention. It has been found that when tungsten is alloyed with a second metal component to form the tungsten heavy alloys and the alloy forming materials are fed to the plasma zone it is necessary to retain the materials in the plasma zone for a sufficient time to enable the second metal component to reach its melting point. Care must be taken to not allow the temperature of the agglomerates to rise above the boiling point of the metal having the lowest boiling point in the second component. By the practice of this invention excessive losses of the second component are avoided.

In the practice of this invention, tungsten heavy alloys can be formed containing from about 70% to about 98% by weight of tungsten. Preferred tungsten heavy alloys are those containing from about 88% to about 98% by weight of tungsten while especially preferred alloys are those containing from about 93% to about 98% by weight of tungsten.

In producing tungsten heavy alloys of this invention, from about 70% to about 98% by weight of the alloy is tungsten and the balance is a second component selected from nickel, iron copper and mixtures thereof. When nickel and iron are used as the second component, a weight ratio of from about 1:1 to about 100:1 is satisfactory, however, a weight ratio of from about 2:1 to about 10:1 is preferred, while a weight ratio of from about 6:4 to about 8:2 is especially preferred. When copper is added as a portion of the second component it can be added in amount to replace up to about 50% of the iron thus, the weight ratio of iron to copper in such alloys is from about 1:1 to about 100:1.

After the metals are blended in the desired ratios agglomerates are formed with a volatile water-soluble binder. Organic binders such as polyvinyl alcohol are preferred. However, certain inorganic water-soluble binders can be used. Useful inorganic binders are those metal salts that will decompose to form a volatile material and a metal that is either tungsten or the appropriate second component. When the metal salts are used as the binder, the metal ratios in the blend have to be adjusted to compensate for the additional metal.

U.S. Pat. No. 3,974,245, assigned to the same assignee as the present invention, which is incorporated by reference herein, discloses a method of agglomeration to enable flowability of finely divided powders.

A similar method of agglomeration can be utilized as a continuous method for the practice of this invention. In this continuous method of agglomeration a metal powder blend of finely divided tungsten and finely divided second metal component wherein the second metal component is selected from the group consisting of nickel, iron, copper and mixtures thereof is mixed with a water-soluble binder such as polyvinyl alcohol to form an aqueous slurry. This aqueous slurry is fed to a spray dryer. Particulate material is recovered from the spray dryer which contains the metals and the binder and any residual moisture that has not been removed in the spray drier. Thereafter, the particulate material containing the blended metals and the binder, along with any residual moisture, is heated at a temperature sufficient to decompose or volatilize the binder and remove the residual water, leaving agglomerates of the metals that are intimate mixtures of the tungsten and the second metal component.

Alternatively, batch-wise agglomeration can be achieved in a fluidized bed by feeding a similar slurry to those used in the spray drying described above into a fluidized bed. Thereafter, the particulate material containing the blended metals and the binder, along with any residual moisture is heated at a temperature sufficient to decompose or volatilize the binder and remove the residual water, leaving an agglomerate of the metal. In another embodiment the binder and the particulate material can be mixed in an attritor mill prior to feeding to the fluidized bed.

The resulting agglomerates that range in size from about 10 to about 80 micrometers are entrained in a carrier gas and then fed into a high temperature reactor. While the temperature in the reactor can be quite high, for example about 17,000° C. is not uncommon in a plasma reactor, the outside of the plasma is not nearly as high and can be as low as about 4000° C. It is essential, therefore, that the residence time in the reactor is very short and preferably the agglomerates are injected into the outer edge of the plasma to avoid over heating of the agglomerates. Overheating of the agglomerates can result in loss of some of the second metal component because of excessive vaporization. Thus, the agglomerates are retained in the plasma for a time sufficient to raise at least 50% of the agglomerate mass to a temperature which is above the melting point of the second metal component of the metal powder but is below the boiling point of the lowest boiling metal in the second component.

The stream of dispersed entrained partially molten metal droplets is produced by plasma-jet torch or gun apparatus of conventional nature. In general, the agglomerates are connected to a source of propellant gas. A means is provided to mix the gas with the powder and propel the gas with entrained powder through a conduit communicating with a nozzle passage of the plasma spray apparatus. In the arc type apparatus, the entrained powder may be fed into a vortex chamber which communicates with and is coaxial with the nozzle passage which is bored centrally through the nozzle, however, as previously mentioned the retention time is short and it is preferred to feed the material into the coolest part of the plasma which is normally the outer edge. In an arc type plasma apparatus, an electric arc is maintained between an interior wall of the nozzle passage and an electrode present in the passage. The electrode has a diameter smaller than the nozzle passage with which it is coaxial to so that the gas is discharged from the nozzle in the form of a plasma jet. The current source is normally a DC source adapted to deliver very large currents at relatively low voltages. By adjusting the magnitude of the arc powder and the rate of gas flow, torch temperatures can range from 5500 degrees centigrade up to about 15,000 degrees centigrade. The apparatus generally must be adjusted in accordance with the melting point of the powders being sprayed and the gas employed. In general, the electrode may be retracted within the nozzle when lower boiling second metal components are utilized with an inert gas such as nitrogen while the electrode may be more fully extended within the nozzle when higher boiling second metal components are utilized with an inert gas such as argon.

In the induction type plasma spray apparatus, metal powder entrained in an inert gas is passed at a high velocity through a strong magnetic field so as to cause a voltage to be generated in the gas stream. The current source is adapted to deliver very high currents, on the order of 10,000 amperes, although the voltage may be relatively low such as 10 volts. Such currents are required to generate a very strong direct magnetic field and create a plasma. Such plasma devices may include additional means for aiding in the initiation of a plasma generation, a cooling means for the torch in the form of annular chamber around the nozzle.

In the plasma process, a gas which is ionized in the torch regains its heat of ionization on exiting the nozzle to create a highly intense flame. In general, the flow of gas through the plasma spray apparatus is effected at speeds at least approaching the speed of sound. The typical torch comprises a conduit means having a convergent portion which converges in a downstream direction to a throat. The convergent portion communicates with an adjacent outlet opening so that the discharge of plasma is effected out the outlet opening.

Other types of torches may be used such as an oxy-acetylene type having high pressure fuel gas flowing through the nozzle. The powder may be introduced into the gas by an aspirating effect. The fuel is ignited at the nozzle outlet to provide a high temperature flame.

Preferably the agglomerates and the individual metal particles constituting the second metal component should be relatively uniform in size. Additionally, the agglomerates should be relatively uniform in composition. A relatively narrow size distribution of the second metal component and of the agglomerates is desirable because, under set flame conditions, the largest particles of the second metal component may not melt sufficiently, and the smallest particles may be heated to a temperature where losses through vaporization are excessive. Incomplete melting is a detriment to the product uniformity, whereas vaporization decreases process efficiency. The agglomerates are generally screened prior to feeding them to the plasma to achieve the desired uniformity. For example, three fractions such as −200 mesh to +270 mesh; −270 mesh to +325 mesh and −325 mesh using U.S. Standard Sieve sizes yield the desired uniformity. Preferably, the size ranges for plasma feed powders of this invention are such that about 80 percent of the particles fall within about a 15 micrometer diameter range.

In the preferred process of the present invention, a high velocity stream of partially molten metal droplets is formed. Individual agglomerates will not be completely melted because the material cannot reach the melting point of tungsten which is higher than the boiling point of the second component. At least about 50% of the second metal component is melted to enable the alloys to be formed as well as the resulting spherical particles which are advantageous over non-spherical particles in subsequent powder metallurgy processing. Typically, the velocity of the droplets is greater than about 100 meters per second, more typically greater than 250 meters per second. Velocities on the order of 900 meters per second or greater may be achieved under certain conditions which favor these speeds which may include spraying in a vacuum.

The stream of entrained partially molten metal droplets which issues from the nozzle tends to expand outwardly so that the density of the droplets in the stream decreases as the distance from the nozzle increases. Prior to impacting a surface, the stream typically passes through a gaseous atmosphere which solidifies and decreases the velocity of the droplets. As the atmosphere approaches a vacuum, the cooling and velocity loss is diminished. It is desirable that the nozzle be positioned sufficiently distant from any surface so that the partially molten droplets remain in a droplet form during cooling and solidification. If the nozzle is too close, the droplets may solidify after impact.

The stream of partially molten particles may be directed into a cooling fluid. The cooling fluid is typically disposed in a chamber which has an inlet to replenish the cooling fluid which is volatilized and heated by the molten particles and plasma gases. The fluid may be provided in liquid form and volatilized to the gaseous state during the rapid solidification process. The outlet is preferably in the form of a pressure relief valve. The vented gas may be pumped to a collection tank and reliquidfied for reuse.

The choice of the particle cooling fluid depends on the desired results. If large cooling capacity is needed, it may be desirable to provide a cooling fluid having a high thermal capacity. An inert cooling fluid which is non-flammable and nonreactive may be desirable if contamination of the product is a problem. In other cases, a reactive atmosphere may be desirable to modify the powder. Argon and nitrogen are preferable nonreactive cooling fluids. Hydrogen may be preferable in certain cases to reduce oxides and protect the powder from unwanted reactions.

Since the melting plasmas are formed from many of the same gases, the melting system and cooling fluid may be selected to be compatible.

The cooling rate depends on the thermal conductivity of the cooling fluid and the molten particles to be cooled, the size of the stream to be cooled, the size of individual droplets, particle velocity and the temperature difference between the droplet and the cooling fluid. The cooling rate of the droplets is controlled by adjusting the above mentioned variables. The rate of cooling can be altered by adjusting the distance of the plasma from the liquid bath surface. The closer the nozzle is to the surface of the bath, the more rapidly the droplets are cooled.

Powder collection is conveniently accomplished by removing the collected powder from the bottom of the collection chamber. The cooling fluid may be evaporated or retained if desired to provide protection against oxidation or unwanted reactions.

The particle size of the powders will be largely dependent upon the size of the feed into the high temperature reactor. Some densification occurs and the surface area is reduced thus the apparent particle size is reduced. The preferred form of particle size measurement is by micromergraph, sedigraph or Microtrac. A majority of the particles will be below about 100 micrometers or finer with the average particle size ranging from about 10 to about 80 micrometers. The desired size will depend upon the use of the alloy.

To further illustrate this invention, the following non-limiting examples are presented. All parts, proportions and percentages are by weight unless otherwise indicated.

Example 1

About 900 parts of tungsten powder, 70 parts of nickel powder and about 30 parts of iron powder are mixed together in a V-blender. The material is then attritor milled with heptane for 30 minutes. After milling, the material is dried and screened −100 mesh (U.S Standard Sieve).

After screening, the material is agglomerated to form irregular shaped agglomerates having a size of from about 10 to 80 micrometers using a fluidized bed agglomerator. An aqueous solution of about 300 parts of polyvinyl alcohol and about 3500 parts of water is fed through one inlet of a two fluid nozzle at a rate of about 30–35 parts per hour. Heated air is fed into the other inlet. Inlet air temperature is about 110° C. and outlet air temperature is about 40° C.

The resulting agglomerates are heated for about one hour at about 1000° C. to remove the binder. The dewaxed agglomerates are screened to remove oversized material and to narrow the size range. The three size fractions, −200 to +270; −270 to 325, and −325 mesh are then plasma processed separately.

During plasma processing, the particles are entrained in an argon carrier gas at about 7 SCHF and fed at a rate of about 20 lbs per hour through a high temperature plasma flame consisting of about 80 SCFH Ar and 40 SCFH He. The torch power is about 25 kw, 500 amps and 50 volts. The molten droplets exit into a chamber containing inert gas. The resulting particles have a continuous matrix phase of a tungsten-nickel-iron alloy and a discontinuous tungsten phase consisting of tungsten grains having a size less than about 5 micrometers.

While there has been shown and described what are considered the preferred embodiments of the invention, it will be obvious to those skilled in the art that various changes and modifications may be made therein without departing from the scope of the invention as defined by the appended claims.

What is claimed is:

1. A process for producing tungsten heavy alloy powders comprising:

(a) forming a relatively uniform blend of a relatively finely divided tungsten powder and a relatively timely divided second metal powder component wherein said second metal is nickel, iron and mixtures thereof, wherein the weight ratio of nickel to iron is from about 1% to about 100%, wherein the tungsten constitutes from about 70% to about 98% by weight of the blend and the balance is the second metal component, (b) forming a solid particulate material containing said blend and a volatile binder, (c) forming agglomerates having a size of from about 10 to about 80 micrometers from the particulate material by heating to a temperature sufficient to remove the volatile binder, (d) entraining at least a portion of said agglomerates in a carrier gas to form a mixture, (e) feeding the resulting entrained agglomerates and said carrier gas mixture into a high temperature zone and retaining the agglomerates in the zone for a sufficient time to achieve a temperature in the agglomerates of between the melting point of the second metal component and the boiling point of the lowest melting metal in the second metal component to form partially molten droplets and (f) cooling said droplets to form a powdered tungsten heavy alloy having a continuous phase of an alloy of tungsten and the second metal component and a discontinuous tungsten phase of individual tungsten grains having essentially the same size as the initial tungsten powder particles and wherein tungsten constitutes from about 70% to about 98% by weight of the alloy and the balance is the second metal component.

2. A process according to claim 1 wherein the weight ratio of nickel to iron is from about 6:4 to about 8:2.

3. A process for producing tungsten heavy alloy powders comprising:

(a) forming a relatively uniform blend of a relatively finely divided tungsten powder and a relatively finely divided second metal powder component wherein said second metal is selected from the group consisting of nickel, iron, copper and mixtures thereof, wherein the weight of ratio of nickel to iron plus copper is from about 1% to about 100%, wherein the tungsten constitutes from about 70% to about 98% by weight of the blend and the balance is the second metal component, (b) forming a solid particulate material containing said blend and a volatile binder, (c) forming agglomerates having a size of from about 10 to about 80 micrometers from the particulate material by heating to a temperature sufficient to remove the volatile binder, (d) entraining at least a portion of said agglomerates in a carrier gas to form a mixture, (e) feeding the resulting entrained agglomerates and said carrier gas mixture into a high temperature zone and retaining the agglomerates in the zone for a sufficient time to achieve a temperature in the agglomerates of between the melting point of the second metal component and the boiling pont of the lowest melting metal in the second metal component to form partially molten droplets and (f) cooling said droplets to form a powdered tungsten heavy alloy having a continuous phase of an alloy of tungsten and the second metal component and a discontinuous tungsten phase of individual tungsten grains having essentially the same size as the initial tungsten powder particles and wherein tungsten constitute a from about 70% to about 98% by weight of the alloy and the balance is the second metal component.

4. A process according to claim 3 wherein the weight ratio of iron to copper is from about 1:1 to about 100:1.

5. A process for producing tungsten heavy alloy powders comprising:

(a) forming a relatively uniform blend of a relatively finely divided tungsten powder and a relatively finely divided second metal powder component wherein said second metal is selected from the group consisting of nickel, iron, copper and mixtures thereof, wherein the weight of ratio of nickel to iron plus copper is from about 1% to about 100%, wherein the tungsten constitutes from about 70% to about 98% by weight of the blend and the balance is the second metal component, (b) forming a solid particulate matrial containing said blend and a volatile binder, (c) forming agglomerates having a size of from about 10 to about 80 micrometers from the particulate material by heating to a temperature sufficient to remove the volatile binder, (d) entraining at least a portion of said agglomerates in an inert carrier gas to form a mixture, (e) feeding the resulting entrained agglomerates and said carrier gas mixture into a high temperature zone created by a plasma torch and retaining the agglomerates in the zone for a sufficient time to achieve a temperature in the agglomerates of between the melting point of the second metal component and the boiling point of the lowest melting metal in the second metal component to form partially molten droplets and (f) cooling said droplets to form a powdered tungsten heavy alloy having a continuous phase of an alloy of tungsten and the second metal component and a discontinuous tungsten phase of individual tungsten grains having essentially the same size as the initial tungsten powder particles and wherein tungsten constitutes from about 70% to about 98% by weight of the alloy and the balance is the second metal component.

* * * * *